United States Patent [19]

Jochum

[11] Patent Number: 4,611,738

[45] Date of Patent: Sep. 16, 1986

[54] EXPLOSIVE POWDER DRIVEN FASTENING ELEMENT SETTING DEVICE

[75] Inventor: Peter Jochum, Meiningen, Austria

[73] Assignee: Hilti Aktiengesellschaft, Furstentum, Liechtenstein

[21] Appl. No.: 631,529

[22] Filed: Jul. 18, 1984

Related U.S. Application Data

[63] Continuation of Ser. No. 505,120, Jun. 20, 1983, which is a continuation of Ser. No. 233,186, Feb. 10, 1981, abandoned.

[30] Foreign Application Priority Data

Feb. 13, 1980 [DE] Fed. Rep. of Germany ..... 3005342

[51] Int. Cl.[4] ..... B25C 1/08

[52] U.S. Cl. ..... 227/9; 227/10

[58] Field of Search ..... 227/9, 10, 11, 26

[56] References Cited

U.S. PATENT DOCUMENTS 4,063,672 12/1977 Jochum ..... 227/10

4,263,836 4/1981 Koine ..... 89/26

FOREIGN PATENT DOCUMENTS 56646 3/1965 Australia .

1110499 4/1968 United Kingdom .

*Primary Examiner*—Donald R. Schran

*Assistant Examiner*—James L. Wolfe

*Attorney, Agent, or Firm*—Toren, McGeady, Stanger, Goldberg & Kiel

[57] ABSTRACT

A setting device arranged to use caseless propellent charges for driving fastening elements, such as bolts, nails and the like, into a hard receiving material, includes a casing containing an axially slidable barrel forming a feed element at its rearward end. A counterpressure member is slidably movably supported within the casing in axial alignment with the barrel. The feed element and counterpressure member combine to form a combustion chamber for the caseless propellent charges. A frusto-conical surface is formed on the counterpressure member and seats in sealing contact with a complementary frusto-conical surface in the casing.

1 Claim, 1 Drawing Figure

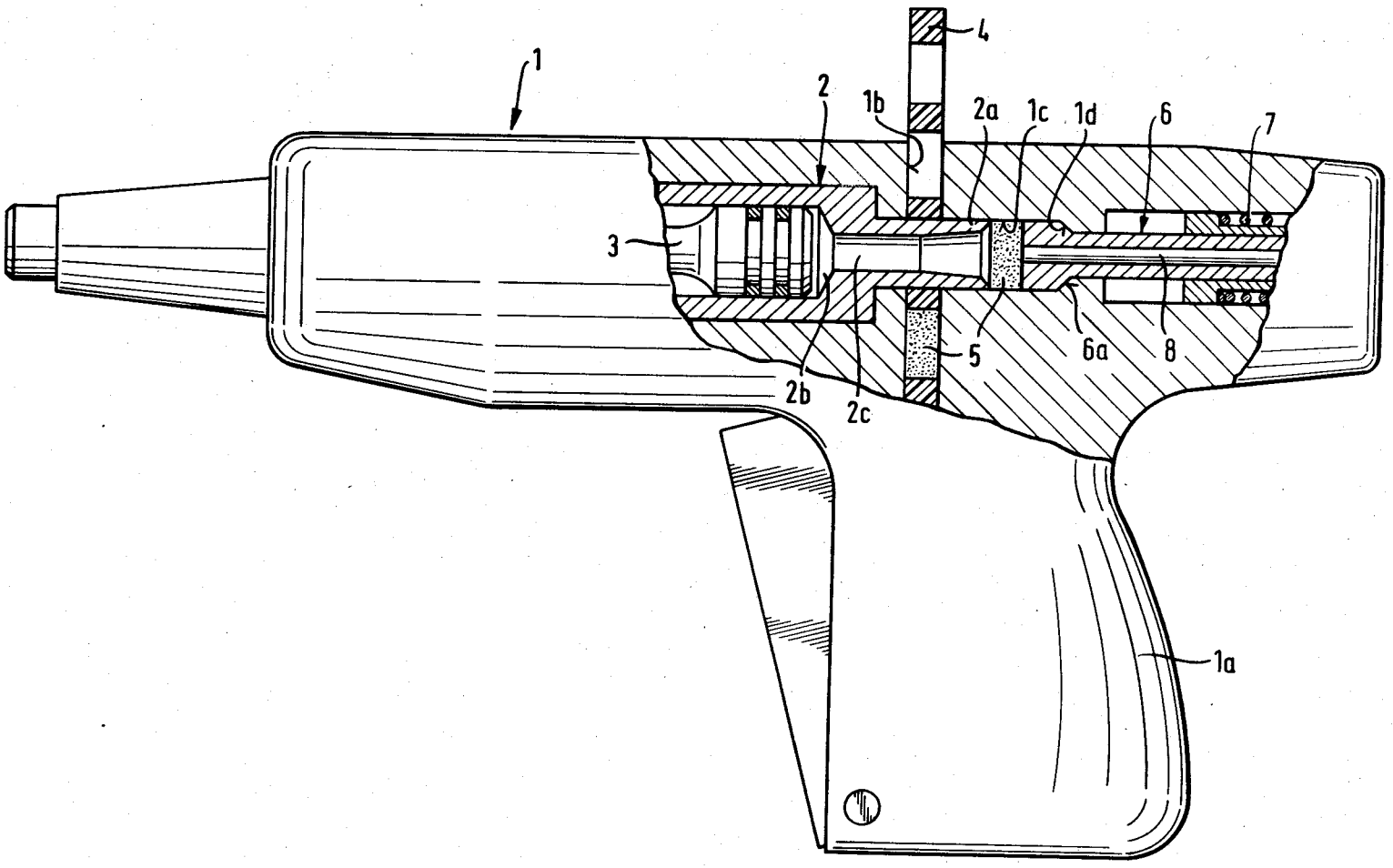
7
6
1d
1c
2a
4
1b
2
1
3
2b
2c
5
6a
8
1a

EXPLOSIVE POWDER DRIVEN FASTENING ELEMENT SETTING DEVICE

This is a continuation of application Ser. No. 505,120 filed June 20, 1983 which in turn was a continuation of application Ser. No. 233,186 filed Feb. 10, 1981, now abandoned.

SUMMARY OF THE INVENTION

The present invention is directed to a setting device using explosive powder force for driving fastening elements, such as bolts, nails and the like, into hard receiving materials. The device includes a combustion chamber located within a casing portion with one side of the chamber being defined by a feed element for caseless propellent charges and the opposite side formed by a counterpressure member through which igniting means extend into the combustion chamber.

Due to the increasing raw material costs for non-ferrous metals, as used for cartridge shells, in recent times there has been an increasing demand for caseless propellent charges. The main problem involved in the use of caseless propellent charges is affording a seal for the combustion chamber. Due to the high peak pressure which results when a caseless propellent charge is fired, a significant amount of of the propellent gases can escape even through a very narrow gap in the seal with a significant reduction in the driving power of the device. Tests using sealing rings, similar to generally known piston rings, have not been able to provide the desired sealing action. Furthermore, because of wear which occurs during operation, gaps which were very small at the outset become enlarged as time goes on.

Therefore, the present invention is directed to providing, in a setting member using caseless propellent charges, an arrangement for providing a seal for a counterpressure member which acts effectively and can continue to function after a long period of operation.

In accordance with the present invention, the counterpressure member includes a frusto-conical sealing surface tapering inwardly in the direction away from the combustion chamber with this surface seating within a complementary shaped sealing surface in the casing of the setting device.

In accordance with the present invention, a so-called frusto-conical fit is provided between the counterpressure member and the casing. Such a frusto-conical fit affords a significantly improved seal as compared to a so-called flat fit, that is, where the sealing surfaces extend perpendicular to the axis of the displaceable counterpressure member. Such improved sealing action is mainly caused by the significantly larger frusto-conical surface provided as compared to a flat surface with the same inner and outer diameters. It is, however, a necessary prerequisite for effective sealing that both sealing surfaces have exactly the same cone angle. This can be accomplished, as in engine manufacturing, by so-called truing, that is, grinding the two sealing surfaces on one another while adding a grinding medium. When one of the parts is replaced, the replacement part should again be ground in with the remaining part. The frusto-conical sealing surface affords self-centering for the counterpressure member. To prevent a redundancy in determination, it is necessary to provide the additional guidances of the counterpressure member with an appropriate play.

At the present time, there are basically two different ways of igniting caseless propellent charges. When the ignition means is in the form of an igniting electrode, it has proved to be especially advantageous. Accordingly, the ignition of the propellent charge takes place electrically. The energy required for ignition can originate from a battery installed in the setting device. Such an arrangement has the advantage that no mechanical energy has to be applied for ignition.

Another known solution involves the use of an axially slidable firing pin as the ignition means. In this instance, the necessary ignition energy is applied by mechanical means. Such an arrangement has a certain disadvantage as compared to electrical ignition. There is a significant advantage in the use of mechanical ignition, however, in that it is unnecessary to replace batteries and ignition can be performed as often as desired.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

The drawing is a side elevational view, partly in section, of a fastening element setting device embodying the present invention.

DETAIL DESCRIPTION OF THE INVENTION

As shown in the drawing, the setting device, includes a generally elongated casing 1 with a handle 1*a* extending downwardly from the casing. As viewed in the drawing, the left-hand end is the front end or muzzle end of the setting device while the right-hand end is the rear end. A barrel 2 is slidably mounted in the casing 1. A driving piston 3 is displaceably guided in the barrel 2. Casing 1 has a magazine channel 1*b* extending perpendicularly of the axial direction of the barrel 2. A magazine 4 containing caseless propellent charges 5 is located within the magazine channel 1*b*. A feed element 2*a* is provided at the rearward end of the barrel 2. Feed element 2*a* serves to push a caseless propellent charge 5 out of the magazine 4 and to move the charge into a combustion chamber 1*c* arranged coaxially with the barrel 2. While one side of the combustion chamber is formed by the feed element 2*a*, the opposite side is formed by a counterpressure member 6. The combination of the feed element 2*a*, the counterpressure member 6 and the surface of the casing 1 form the combustion chamber 1*c*. Counterpressure member 6 is axially slidably supported in the casing 1 and is biased in the direction toward the front end of the casing by a pressure spring 7. The counterpressure member 6 is shaped so that its displacement toward the front end of the casing or barrel is limited to a certain axial dimension. When the front end of the setting device is pressed against the surface of a hard receiving material, the barrel 2 is displaced rearwardly with the feed element 2*a* removing a caseless propellent charge 5 out of the magazine 4 and pressing it against the counterpressure member 6 and displacing the counterpressure member against the biasing force of pressure spring 7. In the drawing, the barrel is shown displaced rearwardly with a caseless propellent charge positioned within the combustion chamber 1*c*. Slightly rearwardly of the end of the counterpressure member forming the opposite wall of a combustion chamber, a frusto-conical surface 6a is formed encircling the axis of the counterpressure member which is in generally coaxial arrangement with the barrel. The frusto-conical surface 6a tapers inwardly in the rearward direction, that is, the direction away from the combustion chamber 1c. The frusto-conical surface 6a is shown in seating contact with a complementary frusto-conical surface 1d in the casing 1. The two frusto-conical surfaces 1d, 6a provide a seal. The cone angle of the frusto-conical surfaces 1d, 6a is in the range of 30° to 60° and preferably is about 45°. Since the counterpressure member is subject to very heavy wear, it is advantageous if it is formed of a steel with a high resistance to wear, for instance, a heat-treatable steel. As mentioned previously, the frusto-conical surfaces cooperating to form a sealing action, should have a sealing quality which is as high as possible. Therefore, it is advantageous to grind the two parts in engagement with one another (to true them). An ignition member 8 extends through an axial bore formed through the counterpressure member 6. The ignition member fires the caseless propellent charge 5 within the combustion chamber 1c. The ignition member can be an ignition electrode so that the caseless propellent charge is fired electrically. Instead of an ignition electrode, a firing pin can also be used which involves mechanical actuation. As can be noted in the drawing the rearward end of the barrel 2 formed by the feed element 2a defines a central passageway 2c leading into the space 2b containing the piston 3. When a caseless propellent charge is fired, the propellent gases travel from the combustion chamber 1c through the passageway 2c into the space 2b and propel the piston 3 toward the muzzle end of the casing for driving a fastening element, located within the barrel ahead of the piston, into a hard receiving material.

While specific embodiments of the invention have been shown and described in detail to illustrate the application of the inventive principles, it will be understood that the invention may be embodied otherwise without departing from such principles.

What is claimed is:

1. A setting device adapted to use an explosive powder propellent for driving fastening elements, such as bolts, nails and the like, into a hard receiving material with the powder propellent being in the form of caseless propellent charges, comprising a casing having a front end and a rear end, means within said casing for forming an axially extending combustion chamber with the axis of said chamber extending transversely of the front end of said casing and said combustion chamber having a first end and a second end spaced apart in the axial direction of said chamber and an axially extending side wall extending between the first and second ends of said combustion chamber, said means comprising an axially extending feed element displaceably positionable in the axial direction of said combustion chamber within said casing and having a first end and a second end with the first end closer to the front end of said casing than said second end, an axially extending counterpressure member in axial alignment with said feed element and having a first end and a second end, said counterpressure member located closer to the rear end of said casing than said feed element, the second end of said feed element forming said first end of said combustion chamber and the first end of said counterpressure member forming said second end of said combustion chamber and the first end of said counterpressure member arranged to provide surface contact across the end thereof with the caseless propellent charge located within said combustion chamber, said counterpressure member being axially slidably displaceable within said casing in the axial direction of said feed element by said feed element displacing the propellent charge, said casing forming said side wall of said combustion chamber, said counterpressure member having a frusto-conical surface thereon encircling the axis of said counterpressure member with said frusto-conical surface spaced from and between the first and second ends of said counterpressure member and tapering inwardly in the direction away from said feed element toward the second end of said counterpressure member and being axially slidable relative to said casing, means located within said casing between said frusto-conical surface and the rear end of said casing for biasing said counterpressure member in the axial direction toward the front end of said casing and said casing having a stationary frusto-conical surface therein diverging toward the front end of said casing and being complementary to said frusto-conical surface on said counterpressure member and arranged to receive said frusto-conical surface on said counterpressure member in sealing contact with said frusto-conical surfaces having exactly the same cone angle, the complementary said frusto-conical surfaces on said counterpressure member and said casing being ground together in engagement with one another for providing a sealing quality as high as possible, said counterpressure member having an axially extending cylindrically shaped larger diameter section extending from the first end thereof to the larger diameter end of said frusto-conical surface thereon and an axially extending cylindrically shaped smaller diameter section extending from the smaller diameter end of said frusto-conical surface toward the second end thereof, and said larger and smaller diameter sections extending from said frusto-conical surface being in axially sliding surface contact with said casing as said frusto-conical surface approaches sealing contact with the stationary frusto-conical surface of said casing, whereby said biasing means biases said frusto-conical surface on said counterpressure member in the axial direction toward the front end of said casing and out of engagement from said frusto-conical surface on said casing, and when said feed element is displaced toward the rear end of said casing said feed element forms the first end of said combustion chamber, said counterpressure member moves axially in sliding contact with the surface of said casing forming the side wall of said combustion chamber toward the rear end of said casing and said frusto-conical surface on said casing forms a stop for the axial displacement of said counterpressure member moving toward the rear end of said casing and in the stopped position said frusto-conical surfaces are disposed in stationary contacting engagement and form a seal for propellent gases when a caseless propellent charge is ignited within said combustion chambers, ignition means being located within said casing for firing a caseless propellent charge positioned within said combustion chamber, said ignition means being located within said counterpressure member, and said ignition means comprises an ignition electrode.

* * * * *